US005438913A

United States Patent [19]

Budde

[11] Patent Number: 5,438,913

[45] Date of Patent: Aug. 8, 1995

[54] DIAPHRAGM FOR A PUMP WITH PRESSURIZED BEAD

[75] Inventor: Dirk Budde, Langenfeld, Germany

[73] Assignee: Almatec Techische Innovationen GmbH, Germany

[21] Appl. No.: 238,833

[22] Filed: May 6, 1994

[30] Foreign Application Priority Data

May 6, 1993 [DE] Germany ..... 43 14 968.5

[51] Int. Cl.[6] ..... F01B 19/00; F04B 43/02

[52] U.S. Cl. ..... 92/98 R

[58] Field of Search ..... 92/96, 98 R, 99, 100; 417/395, 383, 385, 413.1

[56] References Cited

U.S. PATENT DOCUMENTS

| | | | |
|---|---|---|---|
| 2,662,478 | 12/1953 | Surre | 92/96 X |
| 4,049,366 | 9/1977 | Becker | 92/99 X |
| 4,881,876 | 11/1989 | Laziou | 92/98 R X |
| 5,074,757 | 12/1991 | Horn | 92/100 X |

*Primary Examiner*—John E. Ryznic

*Attorney, Agent, or Firm*—Bell, Seltzer, Park & Gibson

[57] ABSTRACT

A diaphragm for a pump, in particular a double diaphragm pump for conveying high-purity products, having peripheral radially offset annular beads, such that one of the annular beads is a grooved bead having a groove along its interior surface, and a clamping ring inserted in the groove formed therein, and wherein the groove is in communication with a pressure medium.

17 Claims, 1 Drawing Sheet

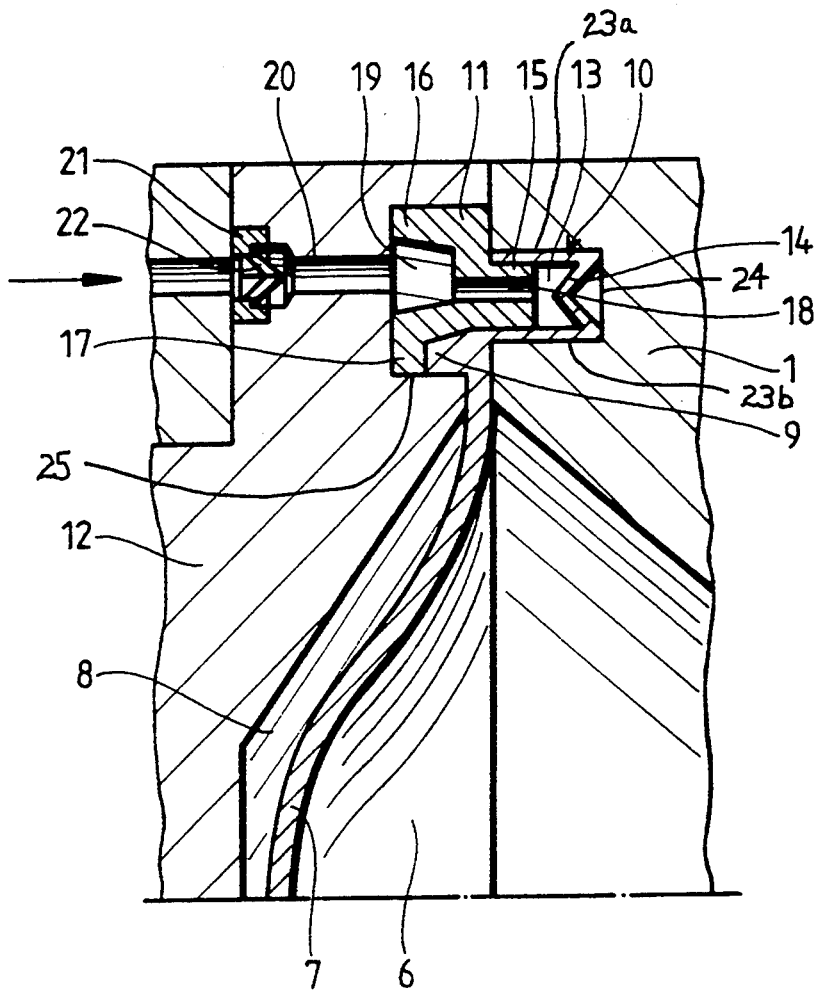
23a
20
19
16
11
15
13
10
21
22
14
24
18
17
1
23b
9
25
12
8
7
6

DIAPHRAGM FOR A PUMP WITH PRESSURIZED BEAD

TECHNICAL FIELD OF THE INVENTION

The present invention relates to the field of pumps, and, more particularly to a diaphragm for a double diaphragm pump for conveying high-purity products, in which the diaphragm includes peripheral radially offset annular beads, one of which includes a groove therein which advantageously receives a clamping ring.

BACKGROUND OF THE INVENTION

An example of this type of diaphragm is described in German patent application P 41 43 371.8-15. This type of diaphragm has a surface which is contacted by the product being conveyed. As a result, it is possible for the surface to be made flat, even and uniform to avoid any internal indentations in which particles may be deposited. In addition, there is only one sealing surface facing the central housing. The diaphragm can thereby be sealed between the central housing and the housing cover while at the same time being fixed in position as is necessary particularly when diaphragms of made solid PTFE-PFM, without a metal core or reinforcing plates, are used.

The diaphragm is constantly pressed against the central housing by the clamping ring. Two of the three surfaces act radially and are independent of the tension in the tension rod which holds the housing cover to the central housing, and one surface acts axially for the greatest possible security. When the housing cover is removed the diaphragm remains seated firmly and sealingly in the central housing thereby protecting the product being conveyed.

In this way, the functions of securing in position and sealing are separated from one another, and the parts performing these functions can each be of optimal form. Sealing of the diaphragm to the housing is effected by the clamping ring placed in the groove in the grooved bead of the diaphragm, which forces the exterior of the two large concentric annular surfaces of the grooved bead of the diaphragm into sealing contact with the interior walls of a corresponding groove in the housing. Thus, these annular surfaces are always kept under pressure by the clamping ring arranged between them, independently of the axial prestressing of the pump, i.e., the clamping force applied by the tension rod holding the housing parts together. Even an axial gap as much as a millimeter wide between the parts of the housing does not lead to loss of tightness or to the diaphragm being pulled out. As a result of this arrangement, servicing and monitoring of the axial prestressing is obviated.

The diaphragm according to the patent application referred to thus exhibits a series of advantages which make it very suitable for use in a double diaphragm pump for conveying high-purity products. However, since the components of the housing which, for reasons of corrosion resistance, consist of fluorothermopolymers of the PTFE family tend to deform under load, the constant prestressing by the diaphragm clamping ring, which is preferably formed from an elastomer of high Shore hardness, can gradually decrease during use of the pump. In addition, the continual stress applied by the clamping ring can also lead to loss of tightness when the pump is at a standstill for prolonged periods because the clamping ring applies force even when the pump is not in use. As a result, the surrounding parts yield and the originally predetermined prestress is thereby reduced. Moreover the high level of prestressing of the diaphragm clamping ring that is required makes assembly of the pump difficult.

OBJECT OF THE INVENTION

In view of the foregoing background, it is therefore an object of the present invention to provide a sealing force that remains substantially constant during use of the pump even when dimensional changes resulting from cold flow of the parts of the housing occur.

SUMMARY OF THE INVENTION

These and other objects, features and advantages of the present invention are obtained by providing a diaphragm of the above-mentioned kind having an internal surface of the grooved bead in communication with a pressure medium. The pressure medium, in turn, forces a portion of the exterior surface of the grooved bead into sealing contact with the housing of the pump. Since the clamping ring no longer has to serve the purpose of providing radial prestress, it can be formed of an elastomer of ordinary hardness of about 60° Shore and need merely have a slight axial projection in order to ensure the necessary initial sealing action for the pressure medium.

The pressure medium is a fluid medium, preferably a gaseous medium, and is most preferably the compressed air used to drive the diaphragm pump, which is readily available in the pump.

In order to lead the pressure medium into the free space and against an end wall of the grooved bead, the clamping ring can be provided with one or more passages in communication with the interior of the groove of the grooved bead for delivering the pressure medium thereto.

The clamping ring, on one axial side thereof, preferably extends into a portion of the groove of the grooved bead, and on the opposite side into a second groove in a cover housing of the pump. The clamping ring includes an annular groove in a cover side portion thereof, and this groove in the clamping ring communicates with the free space in the groove of the grooved bead of the pump diaphragm via at least one opening which extends into the grooved bead. The cover side portion of the clamping ring may include a radial projection which overlaps the adjoining second bead of the diaphragm. If during use an axial gap should form between the pump housing and the housing cover, for example as a result of thermal expansion, the annular groove on the cover side of the clamping ring, which is constantly acted on by compressed air, ensures a constant and reliable seal. The reliable seal results from the action of the compressed air which causes the annular walls of the annular groove in the clamping ring to lie radially against the corresponding faces of the corresponding groove in the housing cover in the same manner as an annular lip seal.

Preferably the portion of the clamping ring which extends into the groove of the grooved bead is somewhat shortened in the axial direction, so that a free space is formed between the portion of the clamping ring that extends into the groove of the grooved bead and the base of the groove. Advantageously, an end wall of the grooved bead arches up convexly or like a roof axially into this free space in the groove of the grooved bead. Pressurizing with compressed air then gives rise to an increase in the sealing force in the radial direction, thereby improving the sealing action. In order to maintain the pressure in the region of the clamping ring, even in the event of short interruptions in the supply of compressed air, at least one non-return or anti-backflow valve, preferably a cone non-return, reed valve consisting of an elastomer and having a cross slit in the cone part can be provided in the pressure medium supply line.

The pressure applied to the axial faces of the diaphragm in the region adjacent the annular bead due to the axial prestressing effects sealing against the medium being conveyed in the pump chamber. The grooved bead with the two radially directed sealing faces of the axially offset side walls and the convexly bulging axial sealing face of the end wall, provides additional sealing. The cover side region of the clamping ring and the annular bead which it overlaps combine to form an additional secondary seal against medium being delivered which might still escape through the three preceding sealing faces. The axial faces of the secondary seal are also pressed against the central housing by the axial prestress and the compressed air.

Since the radial and axial prestress applied by the clamping ring is considerably reduced, assembly of the pump is considerably simplified. Nevertheless the sealing action is improved by the plurality of pressurized sealing faces arranged in series. A further advantage can be seen in the fact that pressure forces only occur in the diaphragm seal region when the pump is in use, while during prolonged stoppages the housing parts are not loaded and therefore no deformation under load can occur.

BRIEF DESCRIPTION OF THE DRAWING

The invention will now be described in more detail, by way of example, with reference to an embodiment shown in the accompanying drawing, which shows, on a large scale, part of a diaphragm with two peripheral annular beads, including a grooved annular bead acted on by a pressure medium.

DETAILED DESCRIPTION OF A PREFERRED EMBODIMENT OF THE INVENTION.

The present invention will now be described more fully hereinafter with reference to the accompanying drawing, in which the preferred embodiment of the invention is shown. This invention may, however, be embodied in different forms and should not be construed as limited to the embodiments set forth herein. Rather, the illustrative embodiment is provided so that this disclosure will be thorough and complete, and will fully convey the scope of the invention to those skilled in the art. Like numbers refer to like elements throughout.

As may be seen in the accompanying drawing, on the outer periphery of a diaphragm 7 there are two radially offset beads 9 and 10. The annular bead 9 lies in a portion of a groove 25 in a housing cover 12. The groove 25 also serves to receive a cover side portion 16 and a radial projection 17 of a clamping ring 11.

The grooved bead 10 is positioned within a corresponding groove 24 in the central housing 1 and includes a groove defining the interior surface thereof. When the grooved bead 10 is positioned in the groove 24, the groove thereof faces axially toward the clamping ring 11. Into this groove projects the housing side portion 15 of the clamping ring 11. The axial dimensions of the housing side portion 15 of the clamping ring 11 are such that a free space 13 is formed within the groove opposite a flexible end wall 14 of the base of the groove, which in turn arches upwards like a roof. At least a portion of the exterior surface of the flexible end wall 14 is in contact with an interior surface of the end face of the corresponding groove 24 in the main housing 1.

Axial openings 18 are provided in the clamping ring 11 to form a fluid connection between the free space 13 and an annular groove 19 in the cover side region 16 of the clamping ring 11. The annular groove 19 can be acted on by a pressure medium, preferably the compressed air used for driving the pump, through an axial opening 20. In this axial opening 20 is arranged a cone-shaped non-return or back-flow valve 21 made of an elastomer, having cross-slit conical sealing part 22, so that the sealing pressure is maintained in the annular groove 19 and in the free space 13, at least for a certain length of time, even if the supply of the compressed air should be interrupted.

The grooved bead be of the diaphragm is also defined in part about its periphery by two radially offset side walls **23*a* and 23*b*. The exterior surfaces of the side walls 23*a* and 23*b* are in contact with interior surfaces of the corresponding annular groove 24 in the central housing 1. Accordingly, the pressure medium directed into the grooved bead exerts pressure against the interior of the side walls 23*a* and 23*b*, and against the interior of the convex, flexible bottom wall 14. In turn, the pressure medium urges the radially directed, exterior sealing faces of the sidewalls 23*a* and 23*b*, and the axially directed, exterior sealing face of the bottom wall 14, into sealing engagement with the corresponding interior faces of the groove 24 in the central housing 1. The positioning of the upwardly arching convex portion of the flexible end wall 14 of the base of the grooved bead 10, between the sidewalls 23*a* and 23*b* thereof, concentrates the load exerted by the pressure medium at the corners of the grooved bead 10 and thus against the solid material of the central housing 1**.

Accordingly, it will be seen that in the present invention the diaphragm 7 serves to separate a product chamber 6 on the housing side and a pressure medium chamber 8 on the cover side, and that these chambers are reliably sealed from one another and from the exterior without the need to apply high axial prestressing to the housing 1 and the housing cover 12.

Many modifications and other embodiments of the invention will come to mind of one skilled in the art having the benefit of the teachings presented in the foregoing description and the associated drawing. Therefore, it is to be understood that the invention is not to be limited to the specific embodiments disclosed, and that modifications and variations are intended to be included within the spirit and scope of the invention as defined in the appended claims.

What is claimed is:

1. A diaphragm for a pump, in particular a double diaphragm pump for high-purity products, comprising:

radially offset peripheral annular beads including a grooved bead having a groove located along an interior surface thereof and a second annular bead radially offset from said grooved bead;

a clamping ring including at least a first portion inserted into the groove of the grooved bead; and a port communicating with said groove for providing a pressure medium thereto.

2. A diaphragm according to claim 1, wherein said port is defined by an axial passage in said clamping ring for supplying the pressure medium to said groove.

3. A diaphragm according to claim 2, wherein said first portion of said clamping ring extends axially into said groove and wherein said clamping ring includes a second portion opposite said first portion thereof extending outside of said groove.

4. A diaphragm according to claim 3, wherein said second portion of said clamping ring includes an annular groove, formed therein and having openings extending therefrom to said groove.

5. A diaphragm according to claim 3, wherein said second portion of said clamping ring further comprises a radial projection overlapping said second annular bead of said membrane.

6. A diaphragm according to claim 1, wherein said groove includes a free space extending between a base portion of said groove and said first portion of said clamping ring.

7. A diaphragm according to claim 6, wherein said grooved bead includes a flexible end wall arching up convexly in the form of a roof towards said free space.

8. A double diaphragm pump for high-purity products comprising:

a central housing having an annular groove formed therein and a housing cover adjacent said central housing;

a diaphragm having a peripheral annular grooved bead positioned in said annular groove of said central housing, said grooved bead having a groove located along an interior surface thereof, said diaphragm having a second peripheral annular bead radially offset from said annular grooved bead and being positioned adjacent said housing cover;

a clamping ring comprising at least a first portion positioned in said groove of said grooved bead; and a pressure medium in communication with said groove of said grooved bead.

9. A pump according to claim 8 further comprising an annular groove formed in said housing cover, and wherein said clamping ring additionally comprises a second portion opposite said first portion thereof and being positioned in said groove of said housing cover.

10. A pump according to claim 8, wherein said first portion of said clamping ring and a base portion of said groove define a free space therebetween.

11. A pump according to claim 8 wherein said grooved bead comprises a flexible end wall, arching up convexly in the form of a roof towards said free space.

12. A pump according to claim 10 wherein said clamping ring further comprises an annular groove formed in said second portion thereof and having axial openings in fluid communication with said free space of said groove of said grooved bead.

13. A pump according to claim 12 further comprising a supply line for supplying said pressure medium to said annular groove formed in said second portion of said clamping ring.

14. A pump according to claim 13 wherein said supply line comprises an axial opening extending through said housing cover into said annular groove of said clamping ring.

15. A pump according to claim 14 wherein said axial opening includes a non-return valve for maintaining sealing pressure in said annular groove.

16. A pump according to claim 15, wherein said pressure medium comprises compressed air for urging said wall of said grooved bead into sealing engagement with said central housing.

17. A pump according to claim 8, wherein said second portion of said clamping ring includes a radial projection overlapping said second annular bead of said diaphragm.

* * * * *

UNITED STATES PATENT AND TRADEMARK OFFICE

CERTIFICATE OF CORRECTION

PATENT NO. : 5,438,913

DATED : August 8, 1995

INVENTOR(S) : Budde

It is certified that error appears in the above-indentified patent and that said Letters Patent is hereby corrected as shown below:

On the title page, item [73] "Techische" should be --Technische--.

[56] References Cited:

Please add the following cited references 5,261,789 11/1993 Butts et al.

[56] Foreign Priority Data

Please add the following cited references as cited in Information Disclosure Statement dated September 23, 1994:

| | |
|---|---|
| Germany | 1 503 429 |
| France | 1 064 799 |
| Japan | 59-63383 |

Signed and Sealed this

Third Day of September, 1996

Bruce Lehman

*Attest:*

BRUCE LEHMAN

*Attesting Officer*

*Commissioner of Patents and Trademarks*